United States Patent [19]

Praeg

[11] Patent Number: 4,472,755

[45] Date of Patent: Sep. 18, 1984

[54] RESONANT CIRCUIT WHICH PROVIDES DUAL FREQUENCY EXCITATION FOR RAPID CYCLING OF AN ELECTROMAGNET

[75] Inventor: Walter F. Praeg, Palos Park, Ill.

[73] Assignee: The United States of America as represented by the United States Department of Energy, Washington, D.C.

[21] Appl. No.: 526,511

[22] Filed: Aug. 26, 1983

Related U.S. Application Data

[63] Continuation-in-part of Ser. No. 356,562, Mar. 9, 1982, abandoned.

[51] Int. Cl.[3] ..... H01F 7/20

[52] U.S. Cl. ..... 361/156; 328/235; 331/151; 361/160

[58] Field of Search ..... 361/152, 155, 156, 160; 331/151, 167; 328/233, 234, 235, 236, 237, 238, 223

[56] References Cited

U.S. PATENT DOCUMENTS

| | | | |
|---|---|---|---|
| 2,899,601 | 8/1959 | Simmons | 331/151 X |
| 3,214,612 | 10/1965 | Hickey | 328/223 X |
| 3,373,325 | 3/1968 | Sipek et al. | 328/235 X |

OTHER PUBLICATIONS

"Ring Magnet Power Supply For A 500 MeV Synchrotron"—Praeg et al., Conference IEE-IAS, Toronto, Canada 1-5/10/78.

"Shaped Excitation Current for Synchrotron Magnets'-'—Foss et al., IEEE Transactions on Nuclear Science vol. NS-28, No. 3, 6/81.

*Primary Examiner*—Harry E. Moose, Jr.

*Attorney, Agent, or Firm*—Bruce R. Mansfield; Paul A. Gottlieb; Michael F. Esposito

[57] ABSTRACT

Disclosed is a ring magnet control circuit that permits synchrotron repetition rates much higher than the frequency of the cosinusoidal guide field of the ring magnet during particle acceleration. the control circuit generates cosinusoidal excitation currents of different frequencies in the half waves. During radio frequency acceleration of the particles in the synchrotron, the control circuit operates with a lower frequency cosine wave and thereafter the electromagnets are reset with a higher frequency half cosine wave. Flat-bottom and flat-top wave shaping circuits maintain the magnetic guide field in a relatively time-invariant mode during times when the particles are being injected into the ring magnets and when the particles are being ejected from the ring magnets.

27 Claims, 15 Drawing Figures

CIRCUIT CURRENTS

MAGNET AND
CHOKE VOLTAGES

RESONANT CIRCUIT WHICH PROVIDES DUAL FREQUENCY EXCITATION FOR RAPID CYCLING OF AN ELECTROMAGNET

CONTRACTUAL ORIGIN OF THE INVENTION

The U.S. Government has rights in this invention pursuant to Contract No. W-31-109-ENG-38 between the U.S. Department of Energy and Argonne National Laboratory.

This is a continuation-in-part of application Ser. No. 356,562, filed Mar. 9, 1982, now abandoned.

BACKGROUND OF THE INVENTION

This invention pertains to electromagnetic circuits, and in particular to circuits which provide magnetic excitation according to a cyclic pattern. One example of cycling electromagnetic fields is found in particle accelerators having a defined particle path, such as a circular ring or "racetrack". Acceleration is typically provided by a plurality of spaced-apart radio frequency resonating cavities which are placed about the ring. Thus, a particular particle or associated group or bunch of particles is accelerated in discrete bursts as it travels around the ring, typically at speeds approaching the speed of light. Particles traveling in the ring are subjected to centripetal forces during particle acceleration. If the particle beam is to be confined within the ring, these centripetal forces must be precisely balanced. The force balancing necessary for particle control is provided by electromagnets located adjacent the several accelerating portions of the ring.

In one type of accelerator, the Rapid Cycling Synchrotron (RCS) located at Argonne National Laboratory, discrete bunches of protons are accelerated for delivery at a designated target. The magnetic confinement of a particular proton bunch must be coordinated with the bunch's injection and ejection from the machine, as well as the duration of residence therein. Such coordination should include a relatively time-invariant magnetic guide field during injection to optimize capture efficiencies. A "flat" magnetic guide field is often also desirable at the end of the acceleration period to eject the particles in discrete bunches during the beam spill time. While protons have been successfully accelerated at pulse repetition rates of 30 pulses per second, an economical means of upgrading the machine by increasing the pulse repetition rate so as to satisfy demands for increasing particle intensity, has been sought.

Economical designs of new machines, as well as the upgrading of existing installations, focus on the maximum pulse repetition rate that can be obtained from a system of given cost. The tradeoff involved in such designs centers around a balance of radio frequency accelerating voltage and the time rate of increase of the magnetic confinement field. Higher pulse repetition rates require more rapid cycling of the magnetic confinement fields of the machine. The shortening of the confinement field rise time, however, requires costly higher voltage rf accelerator equipment.

It is therefore an object of the present invention to provide an economical control circuit, comprised of relatively low-cost components, which energizes and resets an electromagnet in a rapid cyclic pattern.

It is another object of the present invention to provide a control circuit of the above-described type which offers a relatively high pulse repetition rate and which is compatible with relatively low-cost radio frequency accelerator systems.

A further object of the present invention is to provide a control circuit for generating relatively time-invariant operating portions at predetermined points on the rapid cyclic pattern.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects of the present invention are provided by a resonant control circuit which provides rapid cycling energization and magnetic reset for an electromagnet. The resonant circuit is operated at two frequencies, one for the acceleration/confinement and the other for the reset portions of the electromagnet operating cycle, respectively. The electromagnet acceleration/confinement frequency is lower than the electromagnet reset frequency, so as to minimize the time rate of rise of the magnetic confinement or guide field to thereby permit the use of a lower cost radio frequency accelerating system. The electrical circuit, connected in series with the electromagnet winding, comprises a parallel combination of a choke coil, a first fixed capacitor, and a second disconnectable capacitor. The second capacitor is connected in parallel across the choke and first capacitor during the acceleration/confinement portion of the electromagnet operating cycle. The second capacitor is disconnected from the resonant control circuit at the onset of the magnet reset portion of the operating cycle. With the second capacitor element disconnected from the circuit, the frequency of operation of the circuit is increased, allowing an increased magnet reset rate.

Also included in the control circuit is a DC crowbar circuit connected in parallel across the aforementioned parallel combination. The crowbar circuit is switched for connection with the parallel combination during the onset of the acceleration/confinement period, just prior to connection of the second capacitor. A DC power source in the crowbar circuit maintains a relatively time-invariant "flat bottom" magnetic guide field to facilitate particle injection and capture in a rapid cycling synchrotron machine. The crowbar circuit also provides a "flat top" portion of the magnetic guide feed to facilitate particle ejection.

DETAILED DESCRIPTION OF THE PREFERRED EMBODIMENT

Figure 1:
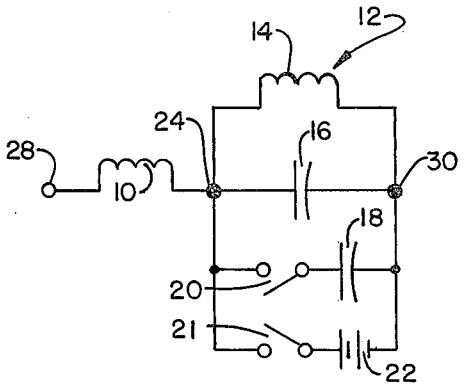
FIG. 1 is a schematic diagram of the resonant circuit according to the invention.

Referring now to the drawings and particularly to the circuit of FIG. 1, an electromagnet 10 is employed in a rapid cycling synchroton proton accelerator to provide a cycling magnetic guide field for the proton beam. The remainder of the circuit of FIG. 1, to which reference numeral 12 is applied, comprises the resonant circuit according to the invention which controls operation of electromagnet 10. The control circuit 12 of FIG. 1 comprises a parallel connection of a choke coil 14, a first fixed capacitor 16 and a second disconnectable capacitor 18. The second disconnectable capacitor 18 is connected across coil 14 and capacitor 16 through a switch 20, which makes and breaks electrical connection at a node 24 where electromagnet 10 is connected to resonant circuit 12. Circuit 12 comprises a resonating tank circuit, wherein the resonating frequency is double valued, depending upon the position of switch 20. The energy stored in the resonating tank of circuit 12 is electrically shifted to electromagnet 10 in proper synchronization with the radio frequency accelerating voltage applied to the proton beam. This synchronizes the accelerating energy and magnetic guide field applied to the proton beam.

Figure 2:
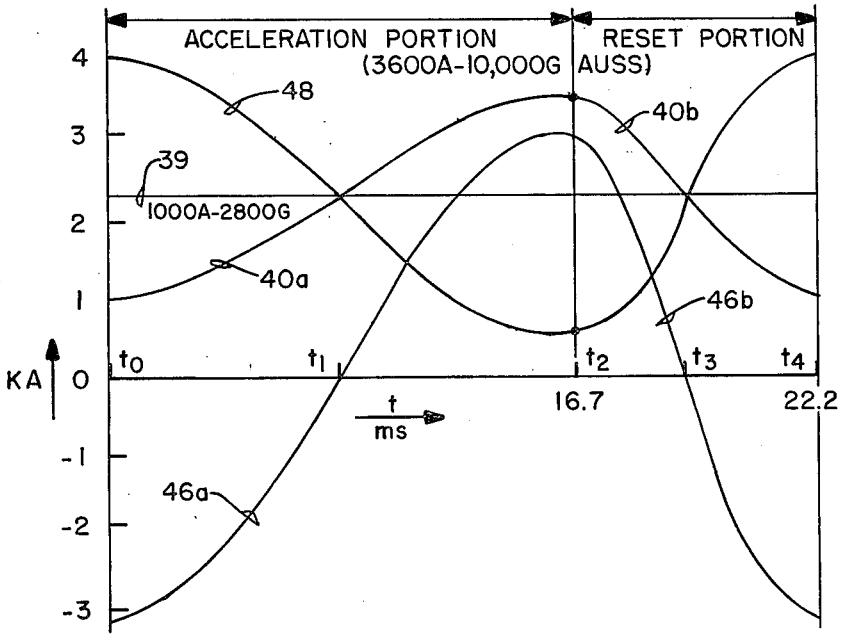
FIGS. 2 and 3 indicate in graphic form, the currents and voltages of the circuit of FIG. 1, respectively.

Operation of electromagnet 10 and resonant circuit 12 will not be described with reference to the waveforms of FIG. 2 which graphically dipict the time-current operating characteristics of electromagnet 10 and resonant circuit 12. FIG. 2 shows one complete cycle of operation of electromagnet 10, starting with a time $t_0$ when a proton beam is injected into the synchrotron machine so as to come within the guide field of electromagnet 10. The proton beam is continuously subjected to magnetic confinement forces during the entire accelerating cycle shown in FIG. 2. Current characteristic curves 39,40 of FIG. 2 indicate the flow of currents through electromagnet 10. Curve 40 comprises first and second portions 40a,40b occurring between times $t_0$,$t_2$ and $t_2$, $t_4$, respectively. These first ("accelerating") and second ("reset") portions of curve 40 are cosine waves of frequencies 30 hertz and 90 hertz, respectively. The second portion 40b of curve 40 initiates the magnet reset operation of the control circuit 12 of FIG. 1, as will be explained hereafter.

The current through electromagnet 10 starts and ends at a level of 1,000 amperes, and has a peak value of 3600 amperes which occurs at time $t_2$. Between time $t_2$ and time $t_4$, the end of the cycle of operation, the current level in electromagnet 10 drops from 3600 amperes to the initial value of 1,000 amperes.

The network combination of electromagnetic 10 and resonant circuit 12 is connected to external energizing ac and dc circuits at terminals 28,30. The signals applied to terminals 28,30 comprise an alternating current signal (curve 40) which is biased by a direct current signal (curve 39) such that all portions of the total signal applied to electromagnet 10 are at all times unidirectional. That is, all portions of the alternating current of curve 40 are maintained unidirectional, so that the protons being accelerated do not experience a magnetic field reversal.

As can be seen in FIG. 2, the rising portion 40a of curve 40, occuring between times $t_0$ and $t_2$, is significantly longer than the fall time of curve 40b which occurs between times $t_2$ and $t_4$. This minimizes the time rate-of-rise of the current flow of curve 40a, which is directly proportional to the time rate-of-rise of the magnetic field, B, set up by the current flowing through electromagnet 10. By way of comparison, the initial current of 1,000 amperes flowing through electromagnet 10 produces a magnetic guide field of 2800 gauss, while the peak electromagnet current at time $t_2$, 3600 amperes, produces a magnetic guide field of 10,000 gauss. As can be seen from studying the entire cycle of operation as shown in FIG. 2, the increased frequency of magnet reset operation provides an improvement over single frequency electromagnet operation, since it allows a significant reduction in the overall period of electromagnet operation with the rise of electromagnet current being stretched over a greater portion of the electromagnet cycle period. Since the rate-of-rise of current in electromagnet 10 is reduced, the time rate of increase of the corresponding magnetic field set up in electromagnet 10 is also minimized. This is particularly crucial to the economic considerations of constructing a synchrotron machine, since higher time-rates-of-change of magnetic guide field require proportionately higher radio frequency accelerating voltages, which are obtainable only at proportionally higher radio frequency circuit costs. Thus, the electromagnet current characteristic curve 40a represents a significant increase in economy of operation.

A method of obtaining the aforementioned electromagnet current characteristics will now be described, with reference to the resonant circuit 12 of FIG. 1, and the portions of FIG. 2 indicating the electrical operation of that circuit. The electromagnet 10 must be excited with a dc bias of 2300 amperes modulated by a 30 hertz sine wave current of 1300 amperes peak. The required magnet current is given by the following relationship:

$$i_M = I_{dc} - I_{ac} \cos \omega_0 t.$$

This magnet current provides the required magnetic field, B, in the ring magnets 10:

$$B = (6440 - 3640 \cos 188\, t)\ G.$$

The above-described electromagnet current is generated with a resonant network comprising the inductance of electromagnet 10 and the inductance and capacitance of circuit 12, where electrical energy is exchanged between the electromagnet and the choke via the capacitors. Since electromagnet 10 must be biased with a dc current, it is necessary to provide a dc bypass around the capacitors of resonant circuit 12. This bypass is accomplished by putting a choke coil 14 in parallel with the capacitors 18,20 so as to resonate the resulting tank circuit at 30 hertz. The resonant frequency of the overall network of electromagnet 10 and control circuit 12 is given by:

$$\omega_0 = \left( \frac{L_M + L_{CH}}{L_M L_{CH} C} \right)^{\frac{1}{2}}$$

where $L_M$ is the inductance of electromagnet 10, $L_{CH}$ is the inductance of choke coil 14, and C is the capitance of the resonant capacitor bank comprised of first and second capacitors 16,18. The capacitor and choke currents are given by:

$$i_C = -\frac{L_M + L_{CH}}{L_{CH}} I_{ac} \cos \omega_o t$$

$$i_{CH} = I_{dc} + \frac{L_M}{L_{CH}} I_{ac} \cos \omega_o t$$

The current waveforms of the capacitor and choke are shown in FIG. 2 as curves 46,48 respectively. The current waveforms of the magnet, curves 39,40 of FIG. 2, have previously been described. The total network stored energy is constant, wherein the magnet-stored energy is transferred to choke coil 14 and back again to electromagnet 10, once per cycle, through the resonant capacitor arrangement of the control circuit.

At injection of a proton bunch in the synchrotron machine, time $t_o$, switch 20 is closed and the currents and voltages of control circuit 12 and electromagnet 10 oscillate at 30 hertz. Between times $t_0$ and $t_2$, the proton bunch is accelerated by the application of radio frequency energy to the proton beam. Thereafter, between times $t_2$ and $t_4$, the accelerating RF power is shut off and electromagnet 10 is reset. At the end of the proton acceleration, time $t_2$, the current in the capacitors 16,18 has reached a peak value. However, the energy in the capacitors is zero. At this point in time switch 20 is opened, disconnecting the second capacitor 18 from the control circuit, thereby causing the control circuit to reset with a 90 hertz half cosine wave. An overall synchrotron repetition rate of 45 pulses per second is achieved by resetting electromagnet 10 with a 90 hertz half cosine wave. Thus, a 45 Hz repetition rate is achieved with an rf system designed for a 30 Hz magnet guide field. Since the cost of an rf system is proportional to the frequency of the magnet guide field, an rf system for 45 Hz is 50% more expensive than an rf system for a 30 Hz guide field.

The switch 20 operates when the current through it is at its peak, the voltage across it is practically zero, and the forward voltage across it is building up at a negligible rate of less than 9.4 volts per microsecond. The capacitor current in the second disconnectable capacitor 18 is zero when switch 20 is closed at the end of the 90 hertz half cycle—time $t_4$, and not at its peak value, as would be required by a 30 hertz resonant circuit. This will cause a small transient, but switching is done with very little transfer of energy; i.e. very few ampere-seconds are required to charge a few thousand amperes into capacitors which have a voltage which is very nearly zero. Problems caused by operation of the switch, such as repeatability and time jitter, are most critical before injection of the proton beam. Therefore, switch 20 should be closed shortly before the 90 hertz operation ends, i.e. shortly before time $t_4$.

In the preferred embodiment, switch 20 is a bi-directional solid-state switch made from back-to-back SCR assemblies and operation of the SCR devices is achieved using conventional control techniques.

Figure 3:
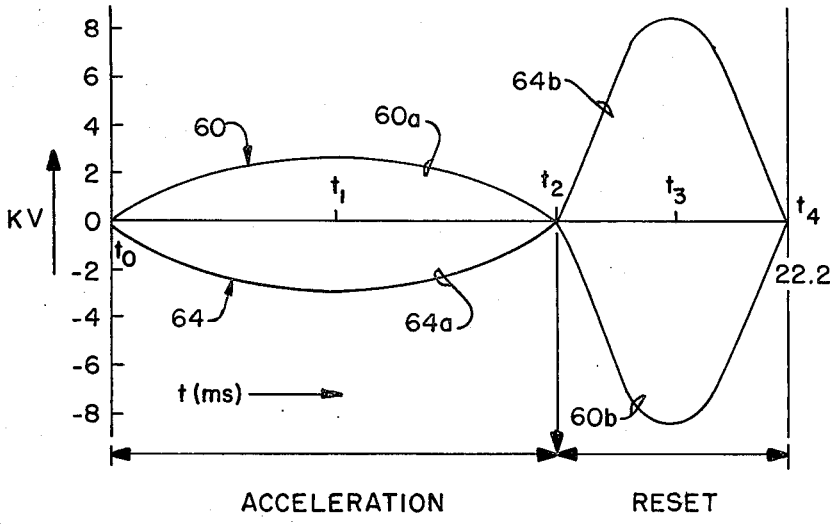

Referring now to FIG. 3, the voltage curves of the components of the resonant circuit are shown for a time period corresponding to that of FIG. 2. The voltage across electromagnet 10 is indicated by a curve 60 comprising first ("accelerating") and second ("reset") portions 60*a* and 60*b* occurring between times $t_0-t_2$ and $t_2-t_4$, respectively. Curve 60 is directly proportional to the time rate of change of the magnetic field set up by the coil, $\dot{B}$. In FIG. 3, curve 64 shows the voltage across the parallel connection of choke coil 14 and first and second capacitors 16,18. A portion of curve 64, designated 64*a*, occurring between times $t_0$ and $t_2$, represents the voltage across choke coil 14, first fixed capacitor 16, and second disconnectable capacitor 18. Between times $t_2$ and $t_4$, switch 20 is open and therefore curve 64*b* indicates the voltage across choke coil 14 and the first fixed capacitor 16. Of major importance to the economical construction of the rf system for the synchrotron, is the magnitude of the voltage across the magnet occurring between times $t_0$ and $t_2$ when the proton beam is being accelerated by the external rf system. This curve, designated by numeral 60*a*, reflects the time rate-of-change of magnetic current, as indicated by curve 40*a* of FIG. 2.

Figure 4:
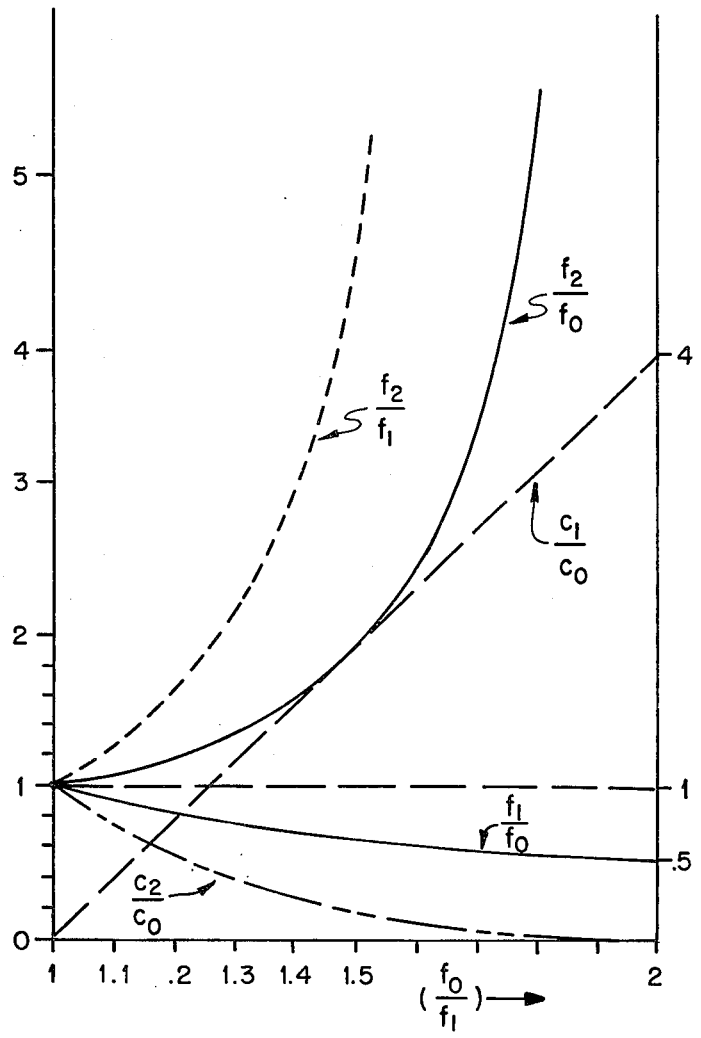
FIG. 4 shows, in graphic form, general design curves for the resonant circuit of the present invention.

General design consideration of the control circuit of the present invention can be seen with reference to the graph of FIG. 4. An acclerating frequency $f_1$ and a reset frequency of $f_2$ result in a synchrotron repetition rate equal to frequency of where:

$$f_0 = 2f_1 f_2/(f_1+f_2).$$

A single frequency operation at $f_o$ requires a capacitor bank $C_o$. The normalized curves $f_1/f_0$, $f_2/f_o$, $C_1/C_0$ and $C_2/C_o$ in FIG. 4 illustrate the trade-offs between single ($f_0$) and dual frequency operation ($f_1$, $f_2$) as a function of $f_0/f_1$. Capacitors $C_1$ and $C_2$ are disconnectable and fixed capacitors, respectively. The peak magnet voltage is proportional to $f_2$. It is apparent from FIG. 4 that this limits the ratio $f_0/f_1$ to values below 1.80. As $f_0/f_1$ increases, the value of the disconnectable capacitor bank $C_1$ increases; however, the capacitor voltage decreases. The opposite is true for the smaller capacitor bank $C_2$ which decreases as $f_0/f_1$ increases, but with an ever higher voltage rating for the capacitors and the switch.

During injection of the proton beam into the synchrotron it is desirable that the magnet guide field is relatively time invariant, and corresponds to the predetermined energy of the particles being admitted into the synchrotron machine. Thus, by operating at a frequency during injection ($f_1$) that is lower than the repetition rate ($f_0$), better injection conditions are provided. The control circuit according to the invention reduces the maximum time rate-of-change of the magnetic guide field, $\dot{B}$, so as to reduce the maximum radio frequency voltage and corresponding rf equipment cost of the required acceleration system. Also, the resonant control circuit lengthens the guide field rise time and shortens the fall time of the guide field so as to improve the duty factor of radio frequency acceleration. Thus, the resonant circuit provides a novel ring magnet control circuit that permits synchrotron repetition rates which are higher than the frequency of the sinusoidal magnetic guide field during acceleration. Consequently, the radio frequency accelerating voltage system is less expensive because the $\dot{B}$ values of the guide field are much smaller than what would be expected from the synchrotron repetition rate.

It will be apparent to those skilled in the art, that the control circuit of the invention could employ disconnectable inductive, as well as capacitive resonator components. An example of this arrangement is shown in FIG. 1, wherein an inductor 21 is connected across terminals 24,30 through switch 22 to form a portion of circuit 12. Also, the control circuit of the invention could be parallel-connected, as well as series-connected, with respect to the electromagnet winding. In any event, the aforementioned expression relating overall resonant frequency $\omega_o$ to resonant circuit component values must be satisfied.

It can be seen that the control circuit described above provides a cosine-shaped wave form at the bottom and top portions of the magnet current curve, 40*a*, FIG. 2. This is the current that flows through electromagnet coil 10, and hence curve 40*a* is herein referred to as a magnet-current operating curve. The bottom portion of the magnet-current operating curve, occurs at times $t_0$, $t_4$. These times represent, when the circuit is applied to a synchrotron machine, times when particles are injected into the machine. More efficient beam capture during injection (i.e. lower beam losses) require a "flat", horizontal, relatively time-invariant magnet current operation. In addition, the flat-top portion of the magnet current operating curve, occurring at time $t_2$, is needed for efficient beam ejection. Beam ejection occurs when the beam is extracted to different beam lines, or when the beam is directed to a designated target.

A description of that part of the present invention which provides flat-bottom and flat-top electromagnet operation will now be described, with reference to a particular rapid-cycling synchrotron designated "SNQ". This synchrotron machine was designed for KFA located in Julich, Germany to serve as a proposed first stage of a spallation neutron source (SNQ). Salient features of a synchrotron operation for this facility will now be described. The rapid-cycling synchrotron was designed to operate at a repetition frequency of 50 pulses per second, with an average proton beam current of 0.5 ma at 1100 Mev. The final pulse duration is no greater than 200 nsec. The ring, having a size of about 240 meters in circumference, has a constant magnetic field for 1.5 msec during injection, capture and bunching, rising to a maximum of 1.05 T at a 33⅓ Hz rate, and the field is reset at a 143 Hz rate. The total cycle requires 20 msec, allowing 50 pulses per second operation. A 50 ma current of $H^-$ particles are injected into the ring using charge exchange injection, to fill both the horizontal and vertical acceptance of the machine. Upon injection, the particles are accelerated according to the arrangements set forth above, which offer improved acceleration characteristics.

Figure 5:
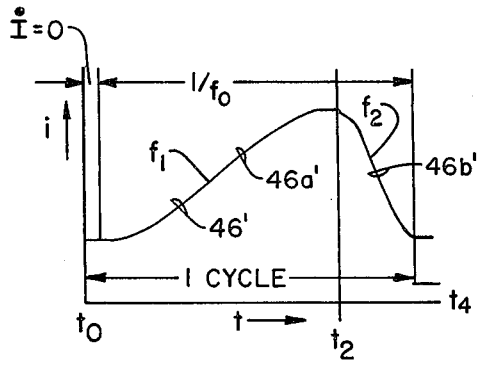
FIG. 5 is a graphical representation of showing an electromagnet cycle of operation showing improved magnet reset and flat-bottom characteristics, according to the present invention.

FIG. 5 shows a magnet current waveform 46, which is essentially the same as that set out in FIG. 2, but with improved flat-bottom characteristics at times $t_0$, and $t_4$. For example, the SNQ machine utilizes a repetition rate of 50 pulses per second, a flat injection field of 1.5 milliseconds duration, an accelerating field of 33.3 Hz and a falling field of 142.9 Hz.

Capacitors are used to resonate with the magnets, in order to save energy. The energy losses during each cycle are supplied by continuous excitation from a modulated multi-phase power supply, such as the one described by W. Praeg and D. McGhee in "Ring Magnet Power Supply for a 500 Mev Synchrotron," Conference Record Industry Application Society, IEEE-IAS, 1978, 13th Annual Meeting, Toronto, October, 1978. This method is utilized in the SNQ machine because of its ability to operate over a wide frequency range, to provide a continuous excitation for a dual-frequency system, to phase-lock to an "infinite-bus" power source or to a stable oscillator, and to provide both dc and ac excitation from one power source.

Figure 6:
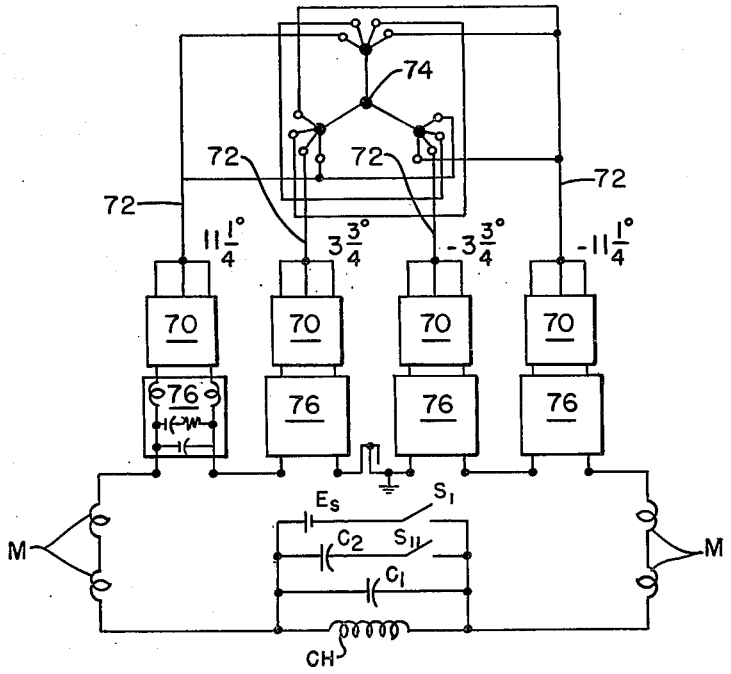
FIG. 6 is a schematic diagram of a circuit according to the invention, having improved flat-bottom current injection.
Figure 7A:
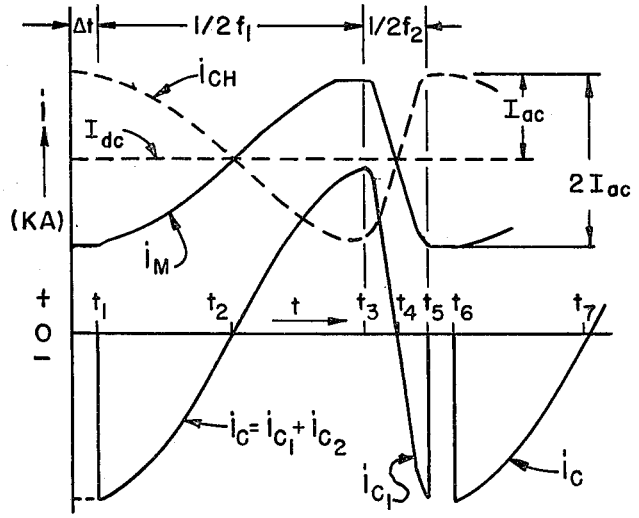
FIGS. 7a–7d indicate in graphic form, the currents, voltages and stored energies of the circuit of FIG. 6.
Figure 7B:
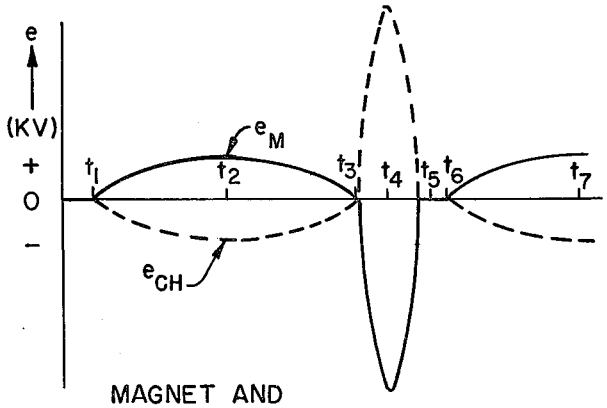
Figure 7C:
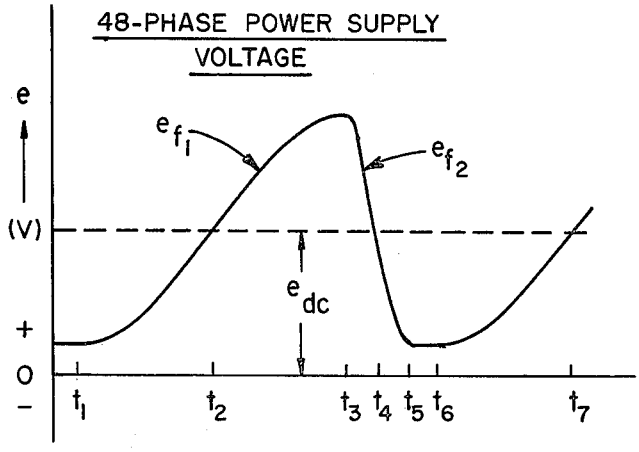
Figure 7D:
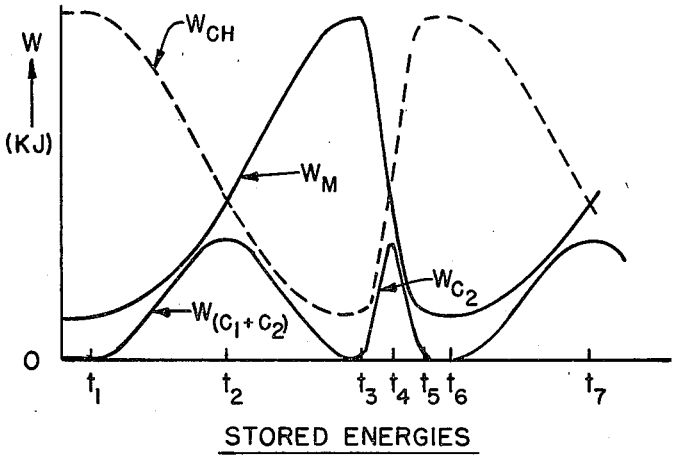
Figure 8A:
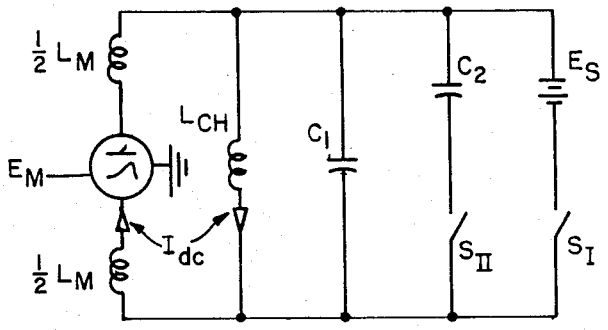
FIGS. 8–10 are schematic diagrams indicating operation of the circuit of FIG. 6.
Figure 8B:
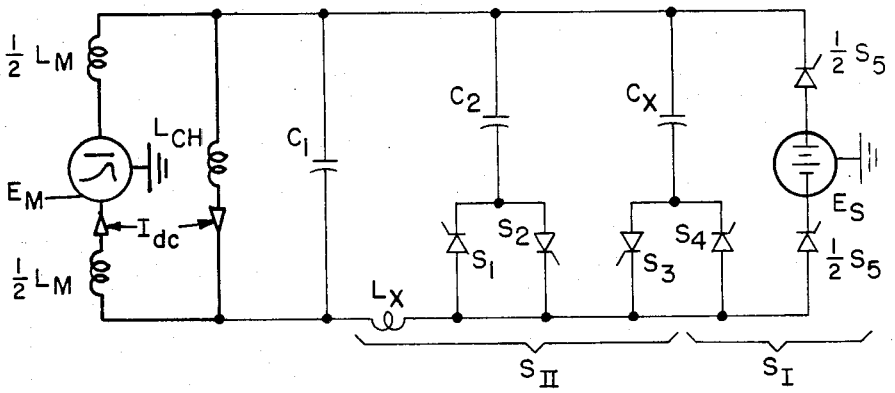
Figure 9A:
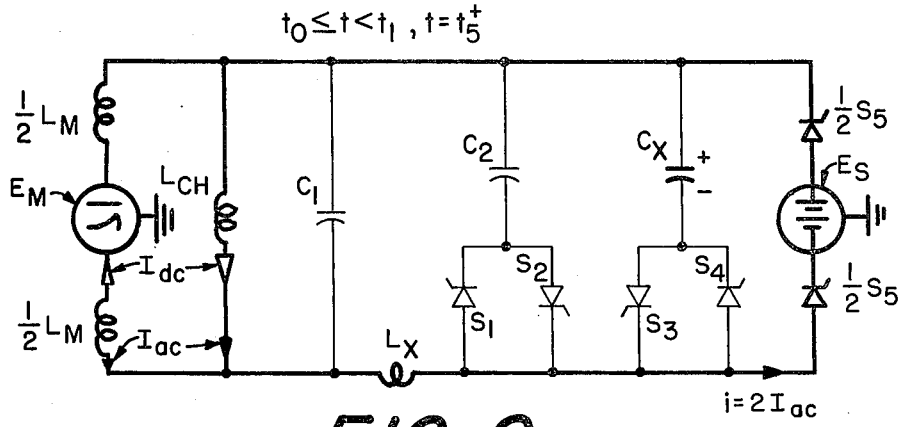
Figure 9B:
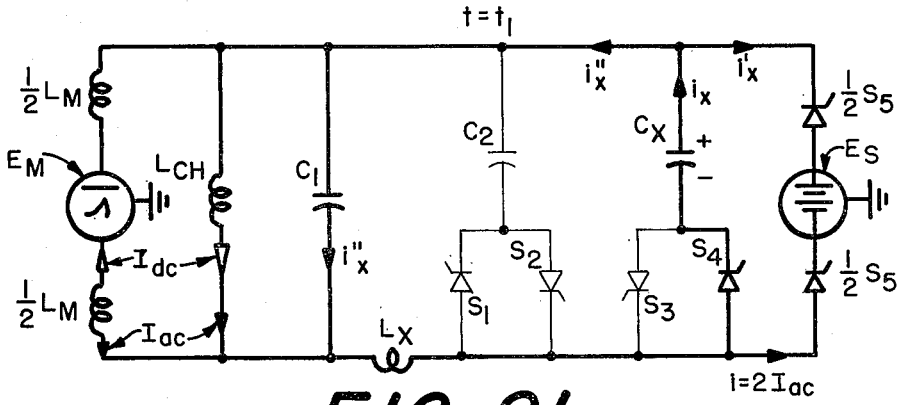
Figure 9C:
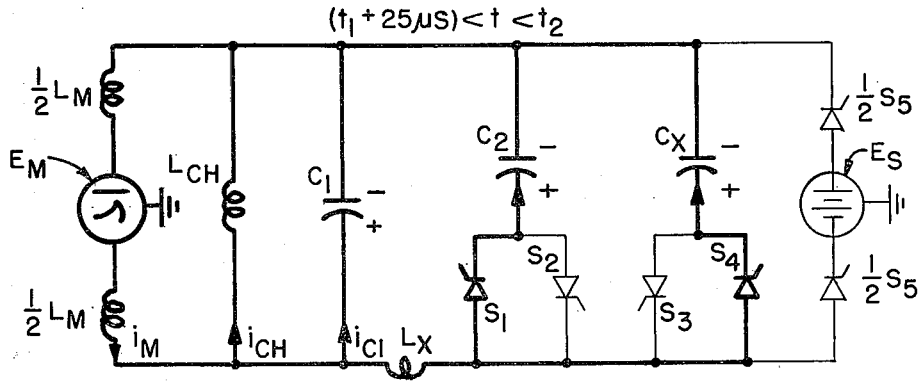
Figure 9D:
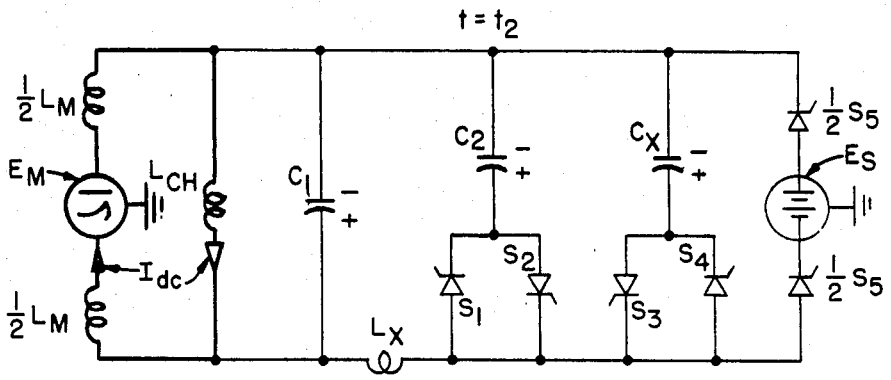
Figure 9E:
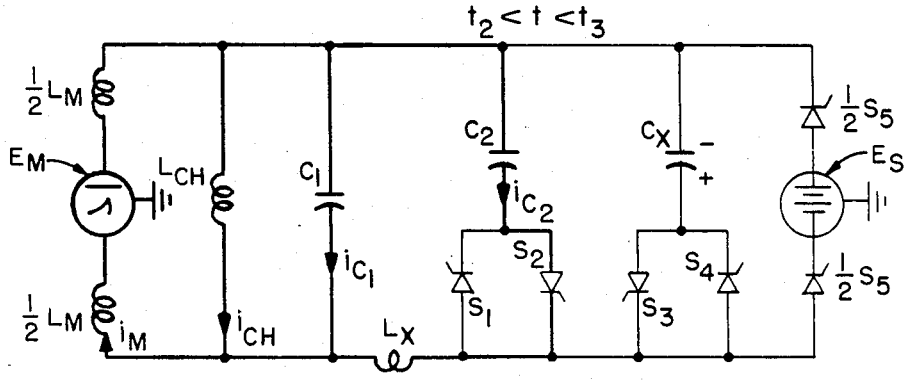
Figure 9F:
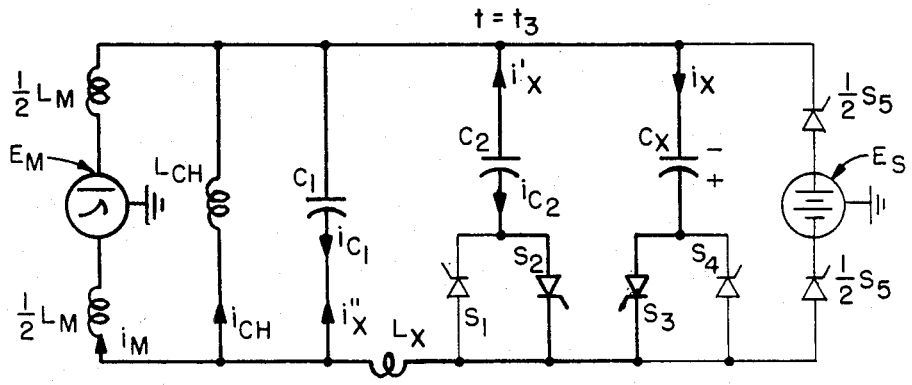
Figure 9G:
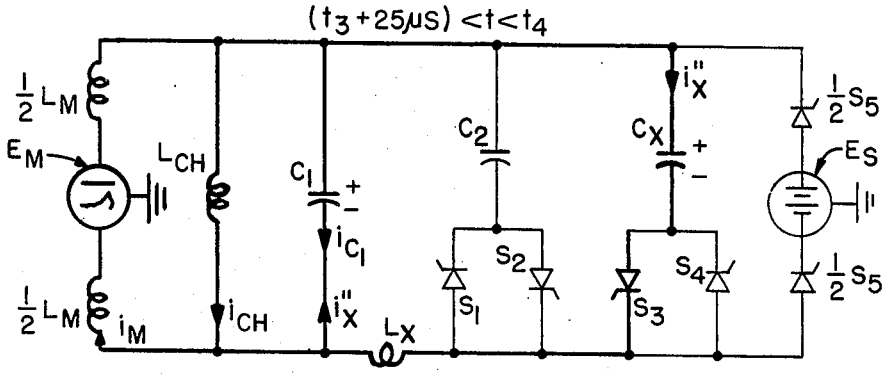
Figure 9H:
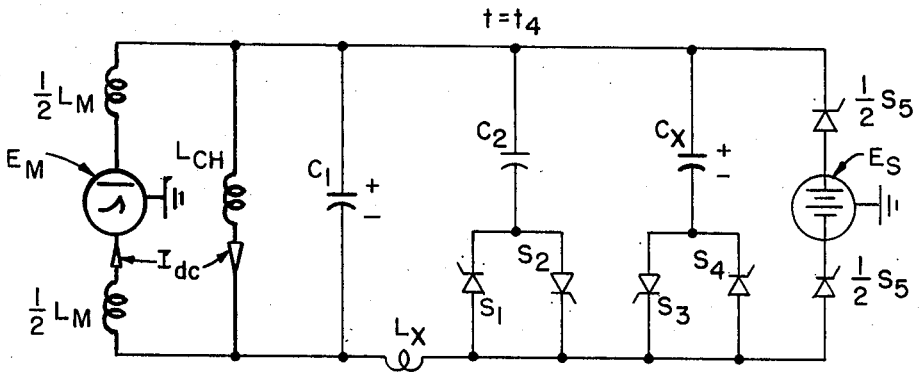
Figure 9I:
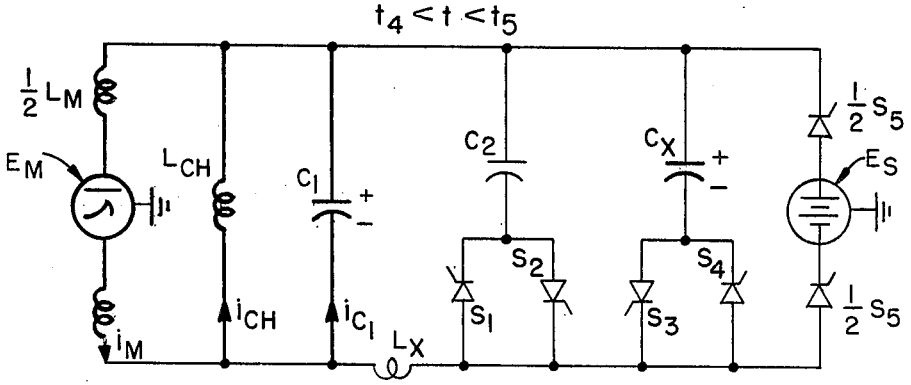

FIG. 6 illustrates an ac-dc power source which generates the desired wave-shape of FIG. 5, by modulating a 48-phase rectifier power supply. A 48-phase system is obtained by connecting in series four identical 12-phase ac power supplies 70, which have their 50 Hz 3-phase ac-input 72 phase shifted by 7.5 electrical degrees with respect to each other. The phase shifting is done by an autotransformer 74. A slightly under-damped low-pass filter 76 attenuates the ripple of each supply, above the operating frequency $\omega_o$. Filter 76 is described in an article by W. Praeg, inventor of the present invention, "A High Current-Low Pass Filter for Magnet Power Supplies," IEEE Transactions on Industrial Electronics and Control Instrumentation," Vol. IECI-17, No. 1, February, 1970.

Neglecting saturation effects, the time-variation of the currents flowing through ring magnet coils M during acceleration is:

$$i_M = I_{dc} - I_{ac} \cos \omega_t. \tag{1}$$

The choke ($i_{CH}$) and capacitor ($i_c$) currents are given by $$i_{CH} = I_{dc} + \frac{L_M}{L_{CH}} I_{ac} \cos \omega_t, \tag{2}$$

$$i_C = i_M - i_{CH} = -\frac{L_{CH} + L_M}{L_{CH}} I_{ac} \cos \omega_t, \tag{3}$$

where $I_{dc}$=dc bias current,
$I_{ac}$=ac current,
$L_M$=magnet inductance,
$L_{CH}$=choke inductance, $$\omega = \left(\frac{L_{CH} + L_M}{C L_{CH} L_M}\right)^{\frac{1}{2}}, \tag{4}$$

C=circuit capacitance.

Except for losses, the total network-stored energy is constant and the choke-stored energy is transferred to the magnet and back again, once per cycle, through the resonant capacitor.

In order to achieve complete transfer of the inductively stored energies, the inductance $L_{CH}$ of the choke CH is made equal to the inductance $L_M$ of the ring magnet coils M. For $L_M = L_{CH} = L$ the circuit currents become:

$$i_M = I_{dc} - I_{ac} \cos\omega t \tag{1}$$

$$I_{CH} = I_{dc} + I_{ac} \cos\omega t \tag{2}$$

$$i_C = i_M - i_{CH} = -2 I_{ac} \cos\omega t \tag{3}$$

$$\omega = \left(\frac{2}{LC}\right)^{\frac{1}{2}} \text{ and} \tag{4}$$

$$e_C = -\left(\frac{2 I_{ac}}{\omega C}\right) \sin\omega t. \tag{5}$$

A flat-bottom field of 3.74 kG will be maintained for 1.5 ms with a crowbar circuit. FIG. 6 shows the crowbar circuit consisting of switches $S_I$, $S_{II}$, capacitors $C_1$, $C_2$ and DC power supply $E_s$. A 50 Hz pulse repetition rate and a lower frequency magnetic guide field during acceleration is obtained by accelerating at 33.3 Hz and resetting the magnets at 142.9 Hz. This reduces the peak value of $\dot{B}$ by 33.3% and the rf peak power by 55.6%, as compared to simple sinusoidal 50 Hz acceleleration. During the 142.9 Hz reset period, the magnet and choke voltages will be 286% higher as compared to 50 Hz sinusoidal operation.

FIG. 5 illustrates the desired magnet current shape which can be produced by the circuit shown in FIG. 6, and FIG. 7 show and the current waveforms of the magnets, capacitors and choke along with voltage and stored-energy curves produced by the circuit of FIG. 6.

In FIG. *7a*, circuit currents passing through the choke, $i_{CH}$; the ring magnet coils, $i_M$; the capacitors $C_1$ and $C_2$, $i_C$, $i_{C2}$, and the DC biasing current $I_{DC}$ are shown. FIG. *7b* illustrates the magnet ($e_M$) and choke ($e_{CH}$) voltages, whereas FIG. *7c* shows the voltage waveform of the 48-phase power supply. FIG. *7d* shows the stored energies, W of the magnet ($W_M$), choke ($W_{CH}$) and capacitors ($W_{C1}$, $W_{C2}$).

FIG. *8a* is a simplified diagram of the circuit of FIG. 6. This idealized circuit is initially energized from the ac-dc power supply with switches $S_I$ and $S_{II}$ open. In this mode the circuit oscillates at 142.9 Hz between 1.44 kA (3.74 kG injection field) and 4.04 kA (10.52 kG ejection field). A flat-bottom magnet current for beam injection is initiated at times $t_0$, $t_5$ etc. (see FIG. 7) when switch $S_I$ is closed; as illustrated in this figure, the voltage of AC/DC power supply $E_M$ maintains the magnet current until time $t_1$. It is not essential to also maintain the choke current constant between times $t_0$ and $t_1$, (which can be accomplished with a DC power source, $E_S$) in the crowbar circuit, as will be explained later. Depending on the values of these dc voltages, $\dot{B}$ values of zero, positive or negative are possible. At time $t_1$ switch $S_{II}$ is closed and switch $S_I$ opens. With capacitors $C_1$ and $C_2$ connected in parallel the circuit oscillates at 33.3 Hz until time $t_3$. At that time, with all the circuit energy in the inductances, switch $S_{II}$ is opened. Between times $t_3$ and $t_5$ the circuit oscillates at 142.9 Hz; the decaying current resets the magnets to the injection field value. The above cycle repeats after time $t_5$.

A solid state switching circuit that performs the functions of the ideal switches $S_I$ and $S_{II}$ is shown in FIG. *8b*. Generally, as will be seen immediately below, FIG. *8b* contains additional commutating means, thyristors $S_1$–$S_5$, a turn-off capacitor $C_X$ and an inductor $L_X$. As mentioned before, the circuit at start-up is run at 142.9 Hz while the magnitudes of the dc and ac currents are being adjusted to the desired operating values. Circuit operation is described with reference to FIGS. 7 and 9. In FIG. 9, heavy lines indicate current flow, and a capacitor symbol drawn heavy indicates a charge on the capacitor. The following is the time sequence of events:

For $t_0 \leqq t < t$ all the energy is stored in the circuit inductances. As shown in FIG. *9a*, silicon controlled rectifiers (thyristors) $S_5$ are turned on, crowbaring the ring magnets M and the choke CH. The difference between these currents $i = i_{CH} - i_M = (I_{dc} + I_{ac}) - (I_{dc} - I_{ac}) = 2\ I_{ac}$ flows through the crowbar. As will be described later, the crowbar may or may not contain a power source in addition to the 48-phase power supply, to allow the beam to be injected into: a falling field ($B<0$, passive crowbar); a rising field ($\dot{B}>0$, active crowbar); a constant field ($B=0$, active crowbar); or any combination thereof.

At $t=t_1$ (FIG. *9b*) thyristors $S_1$ and $S_4$ are turned on. Thyristor $S_4$ provides discharge paths for turn-off capacitor $C_x$ via the crowbar $S_5$ (current $i_x'$) and via $C_1$ and $L_x$ (current $i_x''$). Inductance $L_x$ limits current $i_x''$. Thyristor $S_1$ is back biased until the charge on $C_x$ reverses.

At (t+25 microseconds)$<t<t_2$ (FIG. *9c*) the reverse current $i_x'$ has turned off crowbar thyristors $S_5$. The charge on $C_x$ is reversing and thyristor $S_1$ connects capacitor $C_2$ in parallel with $C_1$. The choke energy discharges at 33.3 Hz into the magnets and the parallel connection of $C_1$, $C_2$ and $C_x$.

At $t=t_2$ (FIG. *9d*), the capacitor current is zero, $i_M = i_{CH}$, and thyristors $S_1$ and $S_4$ turn off. All capacitors are at their 33.3 Hz peak voltage.

At $t_2<t<t_3$ (FIG. *9e*), with thyristor $S_2$ turned on, the capacitor current of $C_1$ and $C_2$ reverses. The charge on $C_x$ remains at its value obtained at time $t_2$.

At $t=t_3$ (FIG. *9f*), the capacitor current is at its peak; capacitor $C_1$ and $C_2$ are discharged. The circuit energy is stored in the inductances. At this time $S_3$ is turned on to provide discharge paths for turn-off capacitor $C_x$ via $S_2$ and $C_2$ (current $i_x'$) and via $L_x$ and $C_1$ (current $i_x''$).

At ($t_3$+25 microseconds)$<t<t_4$ (FIG. *9g*), reverse current $i_x''$ has turned off $S_2$ disconnecting $C_2$ from the circuit. The magnet discharges at 142.9 Hz into the choke and the parallel connected capacitors $C_1$ and $C_x$.

At $t=t_4$ (FIG. *9h*), the capacitor current is zero, $i_M = i_{CH}$, and thyristor $S_3$ turns off. Capacitors $C_1$ and $C_x$ are charged to the 142.9 Hz peak voltage.

At $t_4<t<t_5$ (FIG. *9i*), the capacitor current reverses. At time $t_5$ capacitor $C_1$ is discharged. With all the circuit energy stored in the inductors and with the charge on $C_x$ as shown, the circuit is ready to repeat the above cycle.

The Flat-Bottom Crowbar Circuit will now be described. For magnets with a large L/R time constant a passive crowbar will be sufficient to keep the current flat to within 0.1% for 1.5 ms. Magnets with small time constants require dc driving voltage in the power supply and/or in the crowbar. FIG. 10 shows equivalent circuits for passive and for active crowbars. In these circuits the crowbar thyristors are represented by an ideal switch S in series with a diode D (unidirectional current flow) and a resistor $R_S$. The crowbar resistance $R_S$ will, for practical purposes, be constant during the 1.5 ms injection time. Its value depends on the number of thyristors connected in series. The nominal crowbar current has the same value as the capacitor current current at $t=t_0$, $$I = I_{CH} - I_M = 2I_{ac} = 2.6kA.$$

At 2.6 kA the voltage drop per thyristor will be approximately 2.36 V. Therefore, with n thyristors connected in series the crowbar voltage drop will be $e_S = 2.36$ n volts and the crowbar resistance $$R_S = \frac{2.36\ n}{2.6\ kA} = 0.91\ n \text{ (milliohms).}$$

Figure 10A:
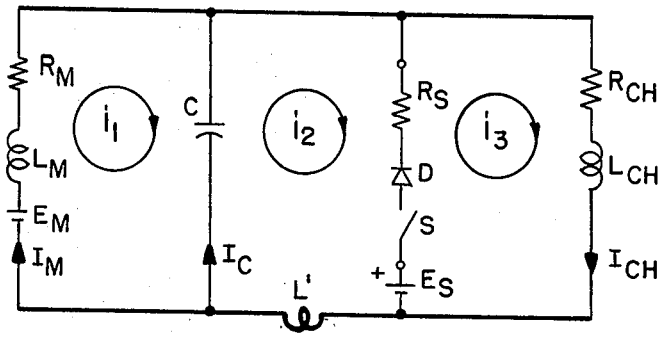
Figure 10B:
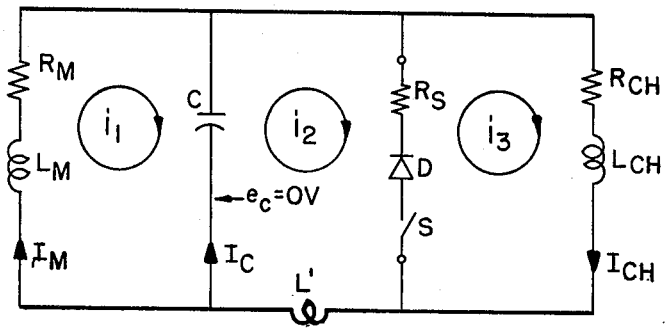
Figure 11A:
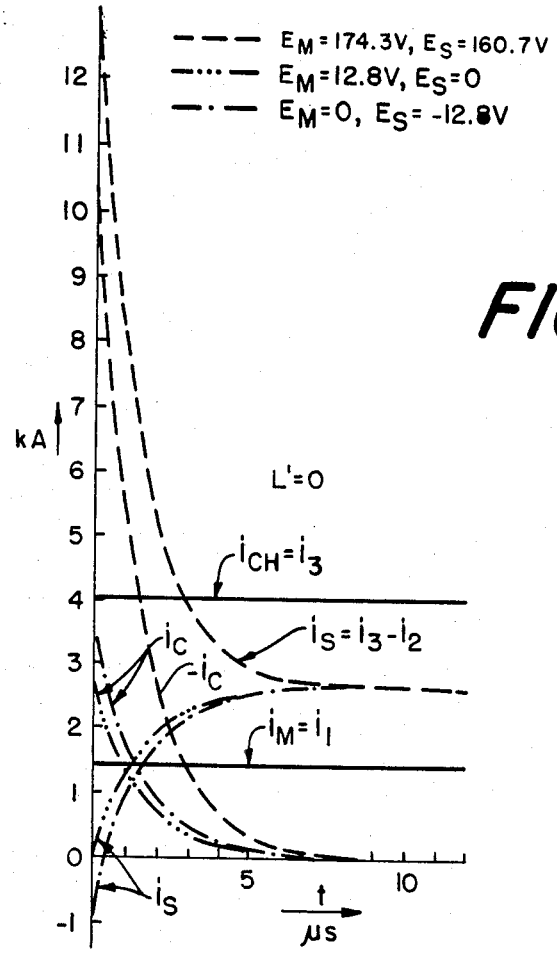
FIGS. 11a, 11b indicate the transient currents and voltages of the crowbar circuits of FIGS. 8–10.
Figure 11B:
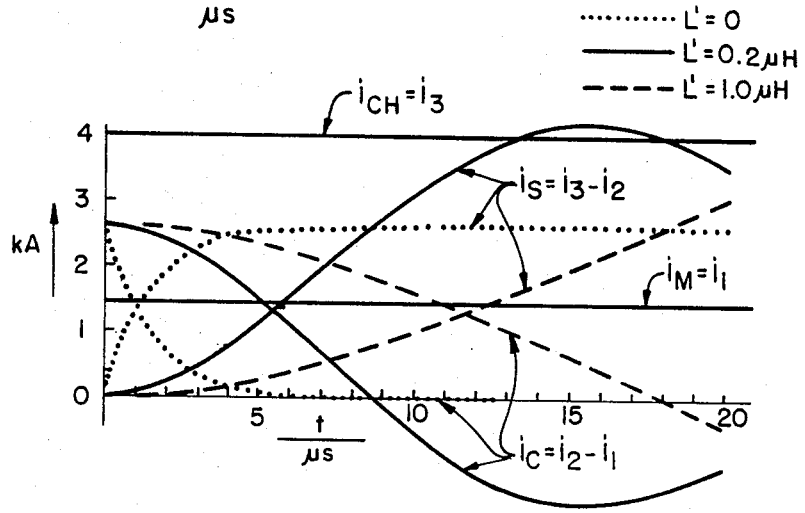

The transient response of the circuit of FIG. 10b to closure of switch S at time $t=t_0$ is shown in FIG. 11b for 6 type M and 8 type $M_1$ bending magnets energized from one power supply. The circuit component values are as shown in FIG. 12, and the initial conditions at $t=t_0$ are: $I_M$, the magnet current, is 1.44 kA; $I_C$, the capacitor current, is 2.60 kA; and $I_{CH}$, the choke current, is 4.04 kA.

Without a driving voltage in the crowbar and with zero voltage on the capacitor, the magnet ($i_M$) and choke ($i_{CH}$) currents, change at time $t=t_0$ at the following rates:

$$\frac{di_M}{dt} = -\frac{I_M R_M}{L_M} = -\frac{1.44\text{ kA} \times 31.8\text{ m}}{23.4\text{ mH}} = -1.96\text{ kA s}^{-1} \quad (6)$$

$$\frac{di_{CH}}{dt} = -\frac{I_{CH} R_{CH}}{L_{CH}} = -\frac{4.04\text{ kA} \times 31.8\text{ m}}{23.4\text{ mH}} = -5.49\text{ kA s}^{-1} \quad (7)$$

with $L'=0$ the current transfers from the capacitor to the crowbar in about 6 microseconds. With $L'>0$ this transfer takes longer and is oscillatory with a frequency of $$f = \frac{1}{2\pi\sqrt{L'C}}.$$

For $L'=0.2$ microhenries, the capacitor current, $i_C$, oscillates at 32.7 KHz above and below its steady state value of zero for about 200 microseconds; the crowbar current $i_S$, oscillates at the same frequency and for the same time around its steady state value of 2.6 kA.

For $L'=1$ microhenry, the oscillations are at 14.6 KHz and last for about 1 ms. These oscillations have a negligible effect on the magnet and on the choke current. After the capacitor current has been transferred to the crowbar, the rate of change in the magnet current is $$\frac{di_M}{dt} = -\frac{I_M R_M - 2.36\,n}{L_M}, \quad (8)$$

while the choke current changes as $$\frac{di_{CH}}{dt} = -\frac{I_{CH} R_{CH} + 2.36\,n}{L_{CH}}. \quad (9)$$

Note, the crowbar voltage drop, $e_S=2\,I_{ac}\times R_S=2.36$ n, reduces the current decay in the magnets but increases the current decay in the choke. For the bending magnets M, with 2.36 n=33 V, we have $$\frac{di_M}{dt} = -\frac{1.44\text{ kA} \times 31.8\text{ m} - 33\text{ V}}{23.4\text{ mH}} = -0.402\text{ kA s}^{-1},$$

$$\frac{\Delta i_M}{I_M} = \frac{0.402\text{ kA s}^{-1} \times 1.5\text{ ms}}{1440} = 4.2 \times 10^{-4} = 0.042\%,$$

and $$\frac{di_{CH}}{dt} = -\frac{4.04\text{ kA} \times 31.8\text{ m} + 33\text{ V}}{31.8\text{ mH}} = -5.08\text{ kA s}^{-1},$$

$$\frac{\Delta i_{CH}}{I_{CH}} = \frac{5.08\text{ kA s}^{-1} \times 1.5\text{ ms}}{4040} = 0.0019 + 0.19\%.$$

A passive crowbar is sufficient for the bending magnets.

For magnets with small L/R time constants, or if the magnet current must be held within tolerances $<<0.1\%$ during the crowbar-time, an active power source is required. The power source may either be in the crowbar, $E_S$, or in the magnet circuit, $E_M$, or in both as shown in FIG. 10*a*.

The transient response of the circuit of FIG. 10*a* is shown in FIG. 11*a* for the bending magnets and for $L'=0$; it illustrates the effects of the power sources $E_M$ and $E_S$. A circuit inductance $L'>0$ would cause an oscillatory delay of the transfer of the current from the capacitor to the crowbar as was illustrated for the passive crowbar. Of the three circuit conditions illustrated by FIG. 12*a*, the most practical one has only one power source, $E_M=12.8$ V, in the magnet circuit. This is described in an article by W. Praeg, "A Ring Magnet Power Supply for Shaped Excitation of the 1.1 GeV Spallation Neutron Quelle", AAD-N-24, December, 1982.

For any crowbar circuit (active or passive), the circuit inductance L' in conjunction with the available forcing voltage will determine the switching time (current transfer time). In order to reduce the commutation reactance to its smallest practicable value, the thyristors will be located close to the capacitor banks. In addition, the inductance of the capacitor banks should be kept small by using transmission lines (strip lines, coaxial cables, coaxial fuse mountings, etc.) for the internal and external connections. Values for the switching reactances can be calculated after the geometry of the capacitor banks has been determined. For purposes of preliminary design, a value less than 2 μH, was assumed for these inductances. In FIGS. 11*a*, 11*b*, circuit components were assigned the following values: $R_s=12.4$ milliohms, $R_M=R_{CH}=31.8$ milliohms, $L_M=L_{CH}=23.4$ millihenries, C=118 microfarads.

Means for obtaining the flat-bottom magnet operating characteristics has been explained. Upon consideration of the above, it will become readily apparent to those skilled in the art that the flat-bottom techniques can be applied to form a flat-top portion at time $t_3$ in FIG. 7*a*, for example, and such modification is considered to form a part of the present invention.

The embodiments of this invention in which an exclusive property or privilege is claimed are defined as follows:

1. A resonant circuit control device for energizing an electromagnet to generate an electromagnet cycle of operation in which the electromagnet has an initial magnetic field value, is raised to a maximum magnetic field value, and is thereafter reset to the initial magnetic field value, the resonant circuit control device comprising:

a first circuit means coupled to the electromagnet so as to form a resonant circuit therewith, for applying an energization of a first frequency to the electromagnet so as to increase the magnetic field value of the electromagnet from the initial value to the maximum value;

a second circuit means coupled to the electromagnet so as to form a resonant circuit therewith, for applying a second higher frequency energization to the electromagnet so as to reset the magnetic field value of the electromagnet from the maximum value to the initial value; and switching means for selectively connecting and disconnecting said first and said second circuit means so as to continuously energize the electromagnet during the electromagnet cycle of operation.

2. The device of claim 1 wherein the magnetic field of the electromagnet is unidirectional during all portions of the electromagnet cycle of operation.

3. The device of claim 2 wherein the energization of the electromagnet during the electromagnet cycle of operation comprises a substantially continuous sequence of substantially sinusoidal waveshapes.

4. The device of claim 3 wherein the energization applied to the electromagnet during the electromagnet cycle of operation comprises a sequence of one-half periods of sine waves of different frequencies.

5. The device of claim 4 comprising a parallel connection of a first number of inductive components and a second number of capacitive components with at least one of said inductive and capacitive components being disconnectable from the control device at predetermined times during the electromagnet cycle of operation.

6. The device of claim 4 comprising a parallel combination of an inductive component, a first fixed capacitive component, and a second disconnectable capacitive component, wherein said switching means is coupled in series with said second capacitive component for disconnecting said second capacitive component from said resonant circuit control device so as to increase the frequency of operation of said electromagnet.

7. The device of claim 6 further comprising an electrical connection means for applying a direct current bias signal through said electromagnet.

8. The device of claim 7 wherein said electrical connection means comprises an inductive component electrically connected across said first and said second capacitive components.

9. The device of claim 8 wherein said resonant circuit control device is electrically connected in series with the electromagnet.

10. The device of claim 8 wherein said resonant control circuit is electrically connected in parallel with the electromagnet.

11. The device of claim 8 wherein the electromagnet comprises the magnetic guide field means of a particle accelerator.

12. The device of claim 9 wherein the electromagnet comprises the magnetic guide field means of a synchrotron particle accelerator machine.

13. A method of cyclically energizing an electromagnet such that each cycle of operation of the electromagnet begins with an initial magnetic field value, is raised to a maximum magnetic field value, and is thereafter reset to the initial magnetic field value, comprising the steps of:

energizing the electromagnet with a first energization of a first frequency such that the magnetic field value of the electromagnet rises from the initial value to the maximum value;

energizing the electromagnet with a second energization of a second higher frequency such that the magnetic field value is reset from the maximum to the initial value; and maintaining the magnetic field of the electromagnet unidirectional throughout the entire cycle of electromagnet operation.

14. The method of claim 13 wherein said first frequency energization and said second frequency energization have substantially cosinusoidal waveshapes.

15. The method of claim 14 wherein said first frequency energization and said second frequency energization comprise a sequence of first and second one-half periods of cosine waves of different frequencies.

16. The method of claim 15 wherein each of said one-half periods of cosine waves extend between minimum and maximum values of their respective cosine wave waveforms.

17. The method of claim 16 wherein said electromagnet comprises the magnetic guide field means of a particle accelerator.

18. The method of claim 17 wherein said electromagnet comprises the magnetic guide field means of a synchrotron particle accelerator machine.

19. A magnetic guide field device for use with a particle accelerator comprising:

an electromagnet;

a first circuit means coupled to the electromagnet forming a resonant circuit therewith, for applying an energization of a first frequency to the electromagnet so as to increase the magnetic field value of the electromagnet from an initial value to a maximum value;

a second circuit means coupled to the electromagnet so as to form a resonant circuit therewith, for applying a second higher frequency energization to the electromagnet so as to reset the magnetic field value of the electromagnet from the maximum value to the initial value; and first switching means for selectively connecting and disconnecting said first and said second circuit means so as to substantially continuously energize the electromagnet during the electromagnet cycle of operation.

20. The device of claim 19 wherein the magnetic field of the electromagnet is unidirectional during all portions of the electromagnet cycle of operation.

21. The device of claim 20 wherein the energization applied to the electromagnet in the cycle of electromagnet operation comprises a sequence of substantially cosinusoidal waveshapes.

22. The device of claim 21 comprising a parallel combination of an inductive component, a first fixed capacitive component, and a second disconnectable capacitive component, wherein said first switching means is coupled in series with said second capacitive component for disconnecting said second capacitive component from said resonant circuit control device so as to increase the frequency of operation of said electromagnet.

23. The device of claim 19 further including a third circuit means coupled to the electromagnet to energize the electromagnet such that the magnetic field set up by the electromagnet is maintained relatively time-invariant immediately prior to application of said energization of said second frequency.

24. The device of claim 19 further including a third circuit means coupled to the electromagnet to energize the electromagnet such that the magnetic field set up by the electromagnet is maintained relatively time-invariant immediately prior to application of said energization of said first frequency.

25. The device of claim 24 wherein said third circuit means comprises a disconnectable direct-current crowbar circuit connected in parallel across said electromagnet.

26. The device of claim 25 wherein said direct-current crowbar circuit comprises a direct-current power source coupled through a second switching means so as to be connected in parallel with said electromagnet, said crowbar circuit further comprising commutating means for selectively disconnecting said second capacitive component while connecting said direct current power source, and for selectively connecting said second capacitive component while disconnecting said direct current power source from said electromagnet, respectively.

27. The device of claim 26 wherein said first and said second switching means includes a plurality of thyristors coupled together for switching currents therebetween.

* * * * *